US006890114B2

(12) United States Patent
Kawaguchi

(10) Patent No.: US 6,890,114 B2
(45) Date of Patent: May 10, 2005

(54) RECORDING APPARATUS

(75) Inventor: Koichiro Kawaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/730,107

(22) Filed: Dec. 9, 2003

(65) Prior Publication Data

US 2004/0081504 A1 Apr. 29, 2004

Related U.S. Application Data

(62) Division of application No. 09/900,949, filed on Jul. 10, 2001, now Pat. No. 6,786,663.

(30) Foreign Application Priority Data

Jul. 17, 2000 (JP) ..... 2000-216287

(51) Int. Cl.[7] ..... B41J 13/076

(52) U.S. Cl. ..... 400/641; 400/625; 400/636; 271/272; 271/314; 347/104

(58) Field of Search ..... 400/625, 636–641; 271/272, 314; 347/104

(56) References Cited

U.S. PATENT DOCUMENTS

| | | | | |
|---|---|---|---|---|
| 4,767,114 A | | 8/1988 | Nishimoto | 101/348 |
| 5,255,023 A | | 10/1993 | Bowlby, Jr. et al. | 347/139 |
| 5,499,807 A | | 3/1996 | Nakamura et al. | 271/121 |
| 5,622,440 A | | 4/1997 | Yamamoto et al. | 400/208 |
| 5,847,719 A | * | 12/1998 | Yamaguchi et al. | 346/134 |
| 5,961,234 A | | 10/1999 | Uchikata | 347/104 |
| 6,203,007 B1 | | 3/2001 | Choi | 271/184 |

* cited by examiner

*Primary Examiner*—Andrew H. Hirshfeld
*Assistant Examiner*—Jill E. Culler
(74) *Attorney, Agent, or Firm*—Fitzpatrick, Cella, Harper & Scinto

(57) ABSTRACT

A discharging unit has multiple discharging rollers for transporting sheets downstream from a recording head in the direction of transporting, arrayed in the direction of transporting. Of the multiple discharging rollers, a second discharging roller disposed farthest downstream in the sheet transporting direction is formed with higher precision than a first discharging roller disposed further upstream.

2 Claims, 12 Drawing Sheets

FIG. 6

- SECOND DISCHARGING ROLLER ① : PRECISION OF EXTERNAL CIRCUMFERENCE ±0.02mm, PRECISION OF DEVIATION 0.05mm
- SECOND DISCHARGING ROLLER ② : PRECISION OF EXTERNAL CIRCUMFERENCE ±0.2mm, PRECISION OF DEVIATION 0.3mm
- FIRST DISCHARGING ROLLER ③ : PRECISION OF EXTERNAL CIRCUMFERENCE ±0.02mm, PRECISION OF DEVIATION 0.05mm
- FIRST DISCHARGING ROLLER ④ : PRECISION OF EXTERNAL CIRCUMFERENCE ±0.2mm, PRECISION OF DEVIATION 0.3mm

TRANSPORTING PRECISION OF SHEET P IN THE EVENT OF TRANSPORTING THE SHEET P WITH THE COMBINATION OF THE SECOND DISCHARGING ROLLER 17 AND FIRST DISCHARGING ROLLER 16 ( 3σ VALUE : INCREMENTS OF μm )

| SECOND DISCHARGING ROLLER \ FIRST DISCHARGING ROLLER | ③ | ④ |
|---|---|---|
| ① | ±12 | ±15 |
| ② | ±35 | ±40 |

RECORDING APPARATUS

This application is a division of application Ser. No. 09/900,949 filed Jul. 10, 2001 now U.S. Pat. No. 6,786,663.

BACKGROUND OF THE INVENTION

1. Field of the Invention

The present invention relates to recording apparatuses, having multiple transporting means for transporting sheets downstream from the recording means, such as facsimile apparatuses, photocopiers, printers, and so forth.

2. Description of the Related Art

A common transporting device for transporting sheets such as recording paper and the like with a recording apparatus such as an ink-jet printer or the like, will be described in brief with reference to FIG. 13.

As shown in FIG. 13, sheets are nipped between and transported by a main transporting roller 113 and a pinch roller 118, and recording is performed by a recording head 111 disposed downstream therefrom. Then, the sheet which has been recorded upon is discharged by a first discharging roller 116 and a first spur 119, and a second discharging roller 117 and a second spur 120 disposed downstream from the recording head 111. Here, the attitude of the sheet following the trailing edge of the sheet having passed through the nipping portion between the main transporting roller 113 and pinch roller 118 is stabilized by using two discharging rollers.

Conventionally, there has been difference in sheet transporting precision in the areas wherein the sheet is transported with the main transporting roller alone and wherein the sheet is transported with the discharging roller alone, but output images have mainly consisted of recording text alone or graphics, so this difference in transporting precision has not been a major problem.

However, in accordance with the improvement in image quality of recording apparatuses in recent years, there are more demands for recording photographic images over the entire recordable area of the sheet, and so improvement in the precision in transporting sheets of the discharging roller alone, to reduce difference with the sheet transporting precision of the main transporting roller, has been awaited.

An arrangement to this end might be conceived wherein the sheet transporting precision is improved with only the discharging roller, to around that of the main transporting roller, but with conventional arrangements such as described above which require multiple discharging rollers, this has resulted in great costs for improving the precision in transporting sheets for all of the discharging rollers.

SUMMARY OF THE INVENTION

Accordingly, it is an object of the present invention to improve transporting precision with multiple discharging rollers without greatly increasing costs, and provide a recording apparatus with good transporting precision at the trailing end of the sheet.

To this end, a recording apparatus for recording on recording sheets by recording means comprises: a transporting roller for transporting recording sheets disposed upstream of the recording means relative to the transporting direction; a proximal discharging roller for transporting recording sheets and being disposed downstream of the recording means relative to the transporting direction; and a distal discharging roller disposed downstream of the proximal discharging roller relative to the transporting direction, and being of higher precision than the proximal discharging roller.

Further objects, features and advantages of the present invention will become apparent from the following description of the preferred embodiments with reference to the attached drawings.

BRIEF DESCRIPTION OF THE DRAWINGS

FIG. 6 is experiment data of the transporting precision of a sheet P under differing levels of precision for the discharging rollers;

DESCRIPTION OF THE PREFERRED EMBODIMENTS

An embodiment of a sheet transporting device to which the present invention has been applied will be described in detail with reference to the drawings. Note that the embodiment described below is an example of a transporting device used with a recording apparatus for transporting recording media at the downstream side of the recording means.

First Embodiment

Figure 3:
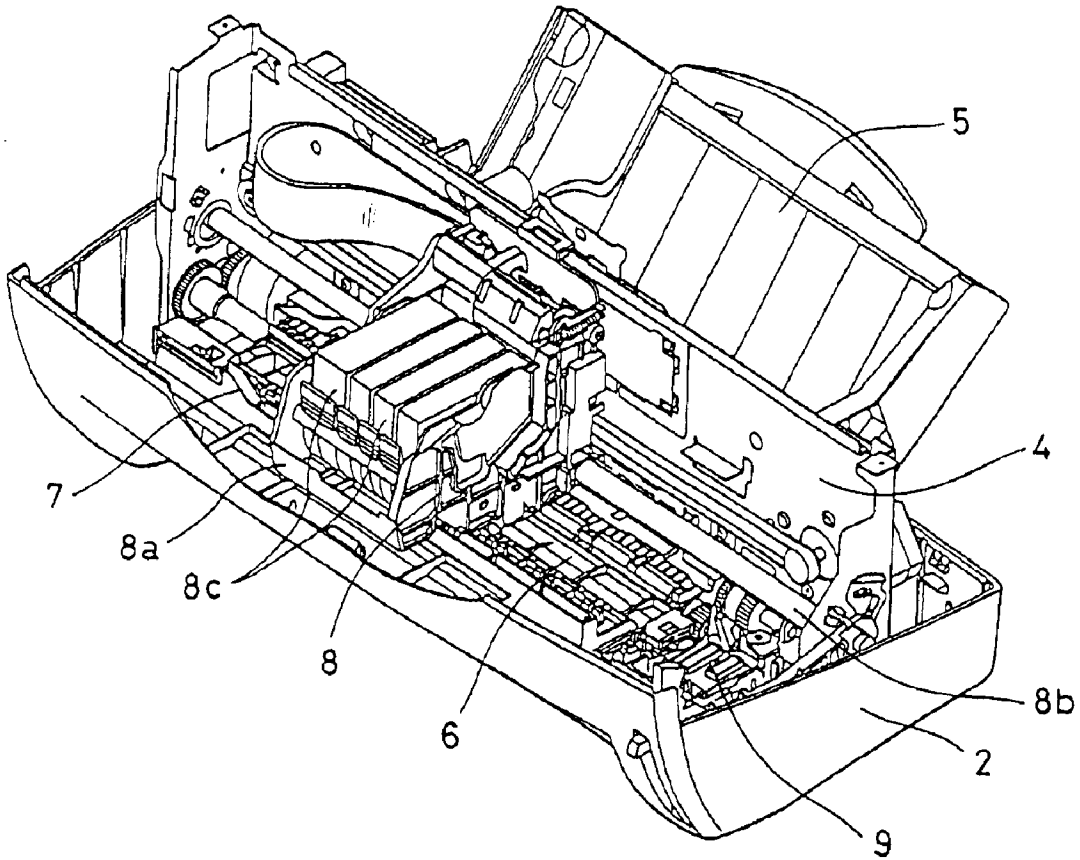
FIG. 3 is a perspective view of within the apparatus.
Figure 4:
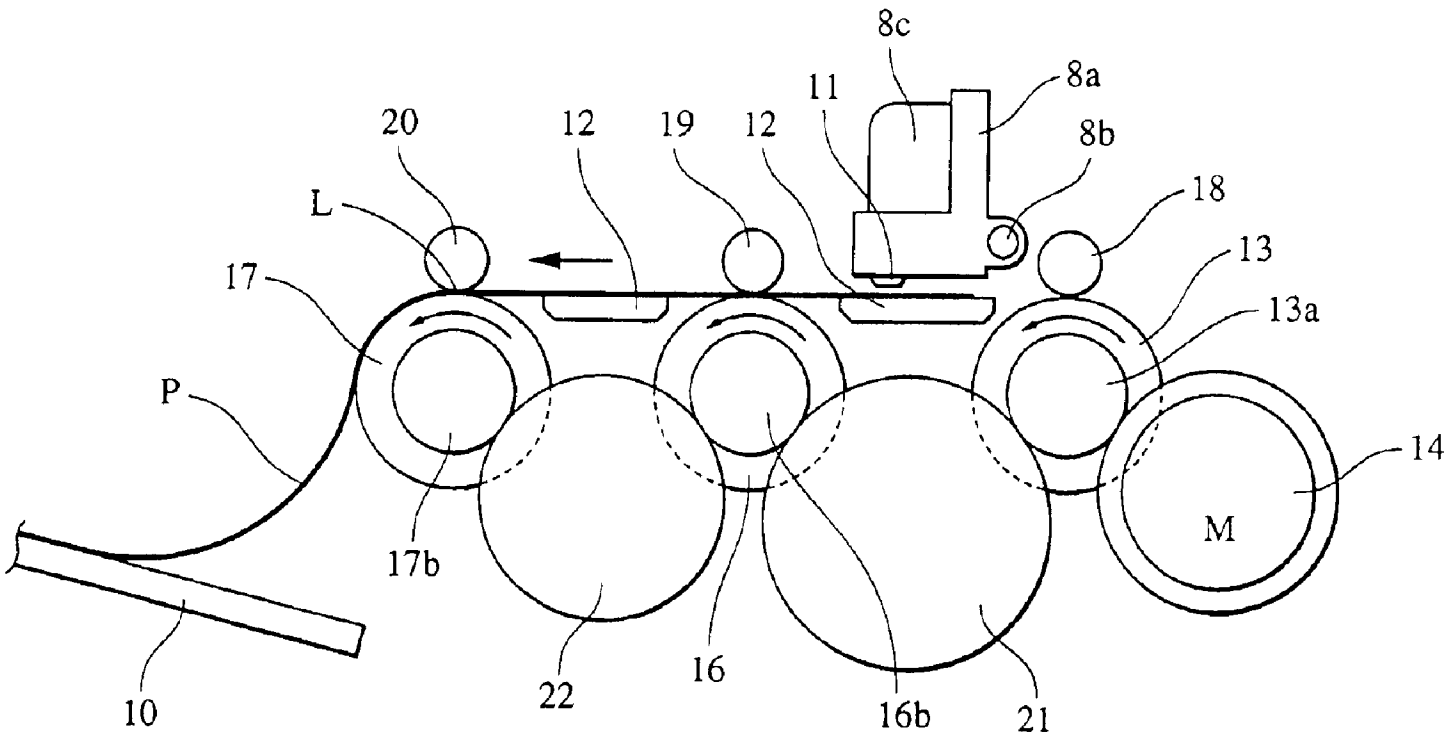
FIG. 4 is a cross-sectional view of a transporting unit and discharging unit according to a first embodiment.
Figure 5:
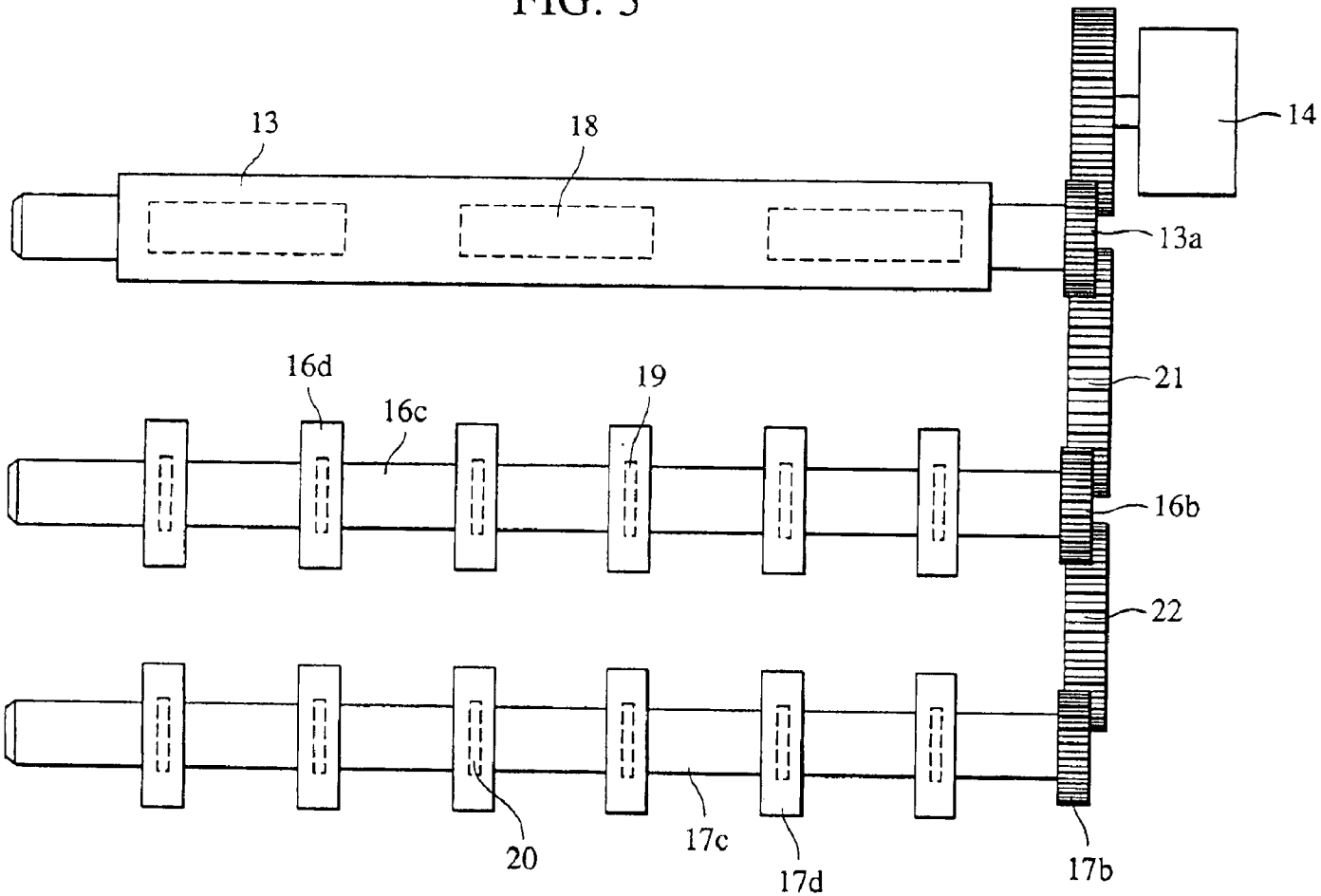
FIG. 5 is an upper view of a transporting unit and discharging unit according to the first embodiment.

A recording apparatus having a sheet transporting device according to the first embodiment will be described with reference to FIGS. 1 through 5. Here, FIG. 1 is a perspective view of a recording apparatus with a movable cover member opened, FIG. 2 is a perspective view of a recording apparatus with a movable cover member closed, FIG. 3 is a perspective view of within the apparatus, FIG. 4 is a cross-sectional view of a transporting unit and discharging unit, and FIG. 5 is an upper view of the transporting unit and discharging unit.

Now, the configuration of the overall apparatus will be described, following which the configuration of the discharging unit which is the sheet transporting device to which the present invention has been applied will be described.

Figure 1:
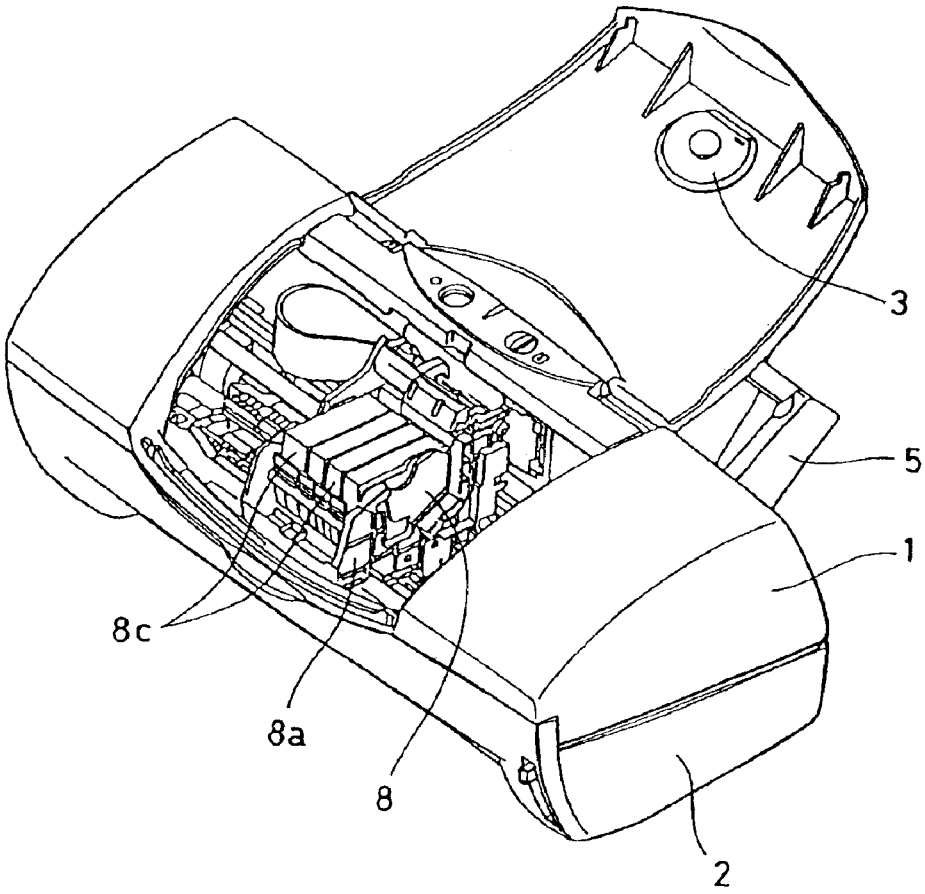
FIG. 1 is a perspective view of a recording apparatus with a movable cover member opened.
Figure 2:
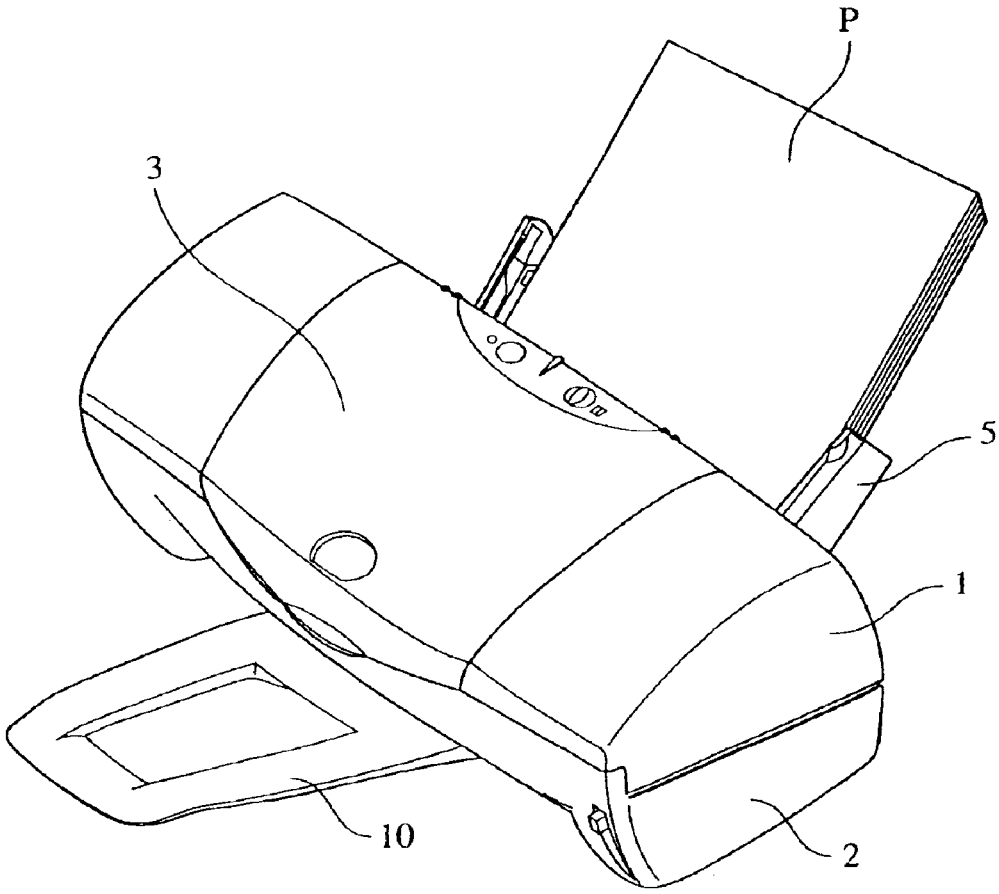
FIG. 2 is a perspective view of a recording apparatus with a movable cover member closed.

As shown in FIGS. 1 and 2, the recording apparatus main unit is covered with a main case 1 and a bottom case 2. These cases 1 and 2 are fixed to a part of a frame of the recording apparatus to configure a fixed cover member, and the cases cover the later-described recording medium transporting unit and recovery unit.

Also, an opening is formed in a part of the main case 1, and an access cover 3 is attached so as to cover the opening. This access cover 3 is rotatably attached to the main case 1 to serve as a movable cover member, and as shown in FIG. 1, opening the access cover 3 allows access to a later-described carriage unit, for replacing heads or ink tanks.

The recording apparatus main unit is within the cover, as shown in FIG. 3. In FIG. 3, reference numeral 4 denotes a chassis serving as a frame of the apparatus, and the main case 1 and bottom case 2 are fixed to the chassis 4.

Also, reference numeral 5 denotes a feeding unit, where sheets P (i.e., recording media) prior to recording are stacked, and a feeding roller not shown in the drawings rotates to separate and feed the sheets P one at a time, according to recording-start signals. The sheets fed therefrom are transported through the recording area by a transporting unit 6 comprising a transporting roller and a pinch roller, and a discharging unit 7 comprising multiple discharging rollers and rotating members with small area of contact with the recording medium such as spurs or the like, and thus discharged.

Also, a carriage unit 8 serving as a recording means is provided in the recording area, so as to perform predetermined recording on transported sheets P. With the present embodiment, serial ink-jet recording has been employed, wherein a carriage 8*a* is attached so as to reciprocally move along a guide shaft 8*b*, and a recording head and ink tank 8*c* are mounted on the carriage 8*a*. Ink is discharged from the recording head synchronously with the movement of the carriage 8*a*, thereby recording an ink image on the sheet P which has been transported into the recording area. Note that a recovery unit 9 is also provided at the end portion of the range of movement of the carriage 8*a*, so as to face the recording head, for suctioning ink from the recording head before starting recording to eliminate defects in ink discharging while recording.

Following recording, the sheets are discharged with the discharging unit 7, and as shown in FIG. 2, are sequentially discharged and stacked in a discharging tray 10 detachably mounted to the bottom case 2 below the discharging unit 7.

Next, the configuration of the discharging unit, which is a sheet transporting device to which the present invention has been applied, will be described with reference to FIGS. 4 and 5. As mentioned earlier, FIG. 4 is a cross-sectional diagram of the transporting unit and discharging unit, and FIG. 5 is an upper view of the transporting unit and discharging unit.

As shown in FIGS. 4 and 5, the transporting unit 6 has a main transporting roller 13 for transporting sheets P, and a platen 12 for setting the distance between the sheets P and the recording head 11. Driving force from a motor 14 is transmitted to the main transporting roller 13. Also, pinch rollers 18 which move synchronously with the main transporting roller 13 due to the friction driving force of the main transporting roller 13 and the sheets P are in contact with the main transporting roller 13. The pinch rollers 18 are pressed toward the main transporting roller 13 by a spring member (not shown in the drawings), thereby generating the force for transporting the sheets P. Also, the pinch rollers 18 are set so that a pressing force of 500 [gf] (4.9 [N]) is applied by each of the pinch rollers 18 to the main transporting roller 13.

Also, the discharging unit 7 is provided downstream of the recording head 11, for stabilizing the behavior of the sheets P during image recording as well as discharging sheets P following recording of images. This discharging unit 7 is configured as a transporting device, comprising discharging rollers 16 and 17 which are two transporting rotating members disposed parallel to the main transporting roller 13, spurs 19 and 20 which are multiple rotating slave members for pressing sheets P against the discharging rollers 16 and 17 and rotating in a manner synchronous thereto, a discharging tray 10 for stacking the discharged sheets P, and so forth.

The discharging rollers 16 and 17 are attached to the platen 12, such that driving force is transmitted from an output gear 13*a* attached to one end of the main transporting roller 13 to discharging roller gears 16*b* and 17*b* provided on one end of the discharging rollers 16 and 17, via transmitting gears 21 and 22.

On the other hand, the discharging tray 10 is disposed lower than the second discharging roller 17 so that multiple discharged sheets P can be stacked thereupon.

Incidentally, the main transporting roller 13, the first discharging roller 16, and the second discharging roller 17, are generally at the same height.

Next, description will be made regarding the image recording operation of a recording apparatus configured thus.

Sheets P divided and fed by the feeding unit 5 are nipped and transported by the main transporting roller 13 and the pinch roller 18. At the point that the sheet P reaches a predetermined position on the platen 12 where an image is to be recorded, the carriage unit 8 reciprocally moves in a direction intersecting the sheet transporting direction, driven by a carriage motor not shown in the drawings, and records an image by the recording head 11 discharging ink toward the sheet P according to signals from an electric board not shown in the drawings.

Now, the portion of the sheet P downstream from the recording head 11 is nipped between the first discharging roller 16 and first spurs 19 and the second discharging roller 17 and second spurs 20, and the portion thereof upstream from the recording head 11 is nipped between the main transporting roller 13 and the pinch roller 18, thereby carrying out transporting and recording. Following recording of a predetermined range from the tip of the sheet P, the trailing edge of the sheet P exits the nipping portion between the main transporting roller 13 and the pinch roller 18. Subsequent transporting is performed by only the multiple discharging roller pairs, thereby enabling recording with the recording head 11 to the very edge of the trailing edge of the sheet P.

Now, with the present embodiment, of the multiple discharging rollers, the second discharging roller 17 which is farthest downstream in the transporting direction is formed with higher precision than the first discharging roller 16 disposed upstream from the second discharging roller 17. Specifically, as shown in FIG. 5, the configuration of the second discharging roller 17 farthest downstream in the transporting direction uses metal (SUM22D+KN plated) for the shaft 17*c*, and rubber (EPDM: Hardness, 70) for the roller portions 17*d* which make up the sheet transporting portion. The second discharging roller 17 realizes external circumference precision of 15 ±0.02 mm in diameter and 0.05 mm in deviation for the roller portions 17*d*, by polishing the roller portions 17*d* following injection of the roller portions 17*d* onto the shaft 17*c*. Such precision can be realized by employing a metal shaft with high rigidity, and polishing the roller portion.

On the other hand, the configuration of the first discharging roller 16 upstream from the second discharging roller 17 uses resin (ABS) for the shaft 16*c*, and thermoplastic elastomer (TPE: Hardness, 70) for the roller portion 16*d* which is the sheet transporting portion. This first discharging roller 16 is fabricated by integrally forming the shaft 16*c* and the roller portions 16*d*. This arrangement has external circumference precision of 15 ±0.2 mm in diameter and 0.3 mm in deviation for the roller portion 16*d*.

In this way, manufacturing the first discharging roller 16 with inexpensive materials and an inexpensive method, and employing a second discharging roller 17 with priority given to precision, allows a sheet feeding configuration to be provided which has struck a good balance between the transporting precision of the sheets P and cost.

Now, the principle by which the transporting precision of the sheet P is improved, by forming the second discharging roller 17 further downstream in the transporting direction with precision higher than that of the first discharging roller 16, will be described.

After the trailing end of the sheet P leaves the main transporting roller 13, the sheet P is transported by the two discharging rollers 16 and 17 as described above, and recording is performed thereupon. The state of the sheet P at this time is such that the portion beyond the second discharging roller 17 dips below the second discharging roller 17 as shown in FIG. 4, and then moves along the discharging tray 10. In this state, a force is acting on the trailing end of the sheet P so as to bend upwards, this force being centered on the line of contact L between the second discharging roller 17 and the second spurs 20. This is a force generated by the weight and resilience of the sheet P itself. The first spurs 19 serve to counter this force and secure a distance between the sheet P and the recording head 11, thereby maintaining a favorable transporting state of the sheet P, but the pressing force of the first spurs 19 as to the first discharging roller 16 is cancelled by an amount equal to the force of the sheet P bending upwards.

On the other hand, the sheet P is in contact with the second discharging roller 17 in a manner wrapping onto the second discharging roller 17 in the circumferential direction thereof, due to the weight of the sheet P. Accordingly, the transporting force of the second discharging roller 17 placed on the sheet P becomes very great. Consequently, of the effects of transporting precision of the first and second discharging rollers 16 and 17, the effect of transporting precision acting upon the sheet P from the second discharging roller 17 is far greater than that of the first discharging roller 16.

Due to such a phenomena, the discharging roller farthest downstream in the transporting direction which has the greatest transporting force to apply to the sheet P is formed to have higher precision than other discharging rollers upstream. The spurs 19 and 20 are disposed facing the roller portions 16*d* and 17*d*, and each apply a relatively small pressing force of 10 [gf] (98 [mN]) on the rubber members (roller portions) by means of spring members not shown in the drawings. This is to prevent damaging the surface of the sheet P which has already been recorded upon, and to maintain a desirable image state.

Experiment data obtained to determine the present configuration is shown in FIG. 6.

As can be understood from the results shown in FIG. 6, a configuration wherein the precision of both the first discharging roller 16 and the second discharging roller 17 are improved exhibits the best results of ±12 μm at σ3, of course, but the configuration described in the present embodiment wherein only the precision of the second discharging roller 17 has been improved secures precision of ±15 μm, which is almost of the same level as that of the arrangement wherein the precision of both discharging rollers has been improved.

This is a great difference as compared to the results of ±35 μm in the event that the precision of the first discharging roller 16 alone is improved, and it is unmistakable that improving the precision of the second discharging roller 17 alone is the most efficient arrangement.

Incidentally, σ3 is a value obtained by multiplying the reference deviation σ by 3, and yield of 99.73% (within the value of σ3) can be anticipated in mass-production. Accordingly, this is a value referenced when studying product manufacturing.

As described above, according to the present embodiment, with an apparatus having a plurality of discharging rollers for discharging sheets, the discharging roller of the plurality of discharging rollers disposed farthest downstream in the sheet transporting direction is formed with precision higher than upstream-side discharging rollers disposed further upstream, and accordingly the transporting precision can be improved with only the discharging rollers, thereby providing good recorded images at the trailing end of the sheets as well. At this time, inexpensive materials and manufacturing methods can be used for the upstream discharging rollers, so the above-described advantages can be obtained without great increases in costs.

Note that the values, material, etc., listed in the present embodiment are only examples, and the present invention need not be restricted to these values, material, etc.

Also, the number of discharging rollers need not be restricted to two; rather, the same advantages can be obtained using multiple discharging rollers of three or more.

Second Embodiment

With the first embodiment, the pressing force of the spurs 19 and 20 to the roller portions 16*d* and 17*d* of the first discharging roller 16 and the second discharging roller 17 was set to 10 [gf] (98 [mN]), but with the present embodiment, the transporting precision of the sheet P at the time of transporting can be further improved with only the discharge rollers by raising only the pressing force of the second spurs 20 onto the roller portions 17*d* of the second discharging roller 17 to 20 [gf] (196 [mN]).

This is because the degree of bearing on the precision of transporting with the second discharging roller 17 with higher roller precision can be increased by making the pressing force of the second spurs 20 as to the roller portions 17*d* of the second discharging roller 17 to be greater than the pressing force of the first spurs 19 as to the roller portions 16*d* of the first discharging roller 16.

Figure 7:
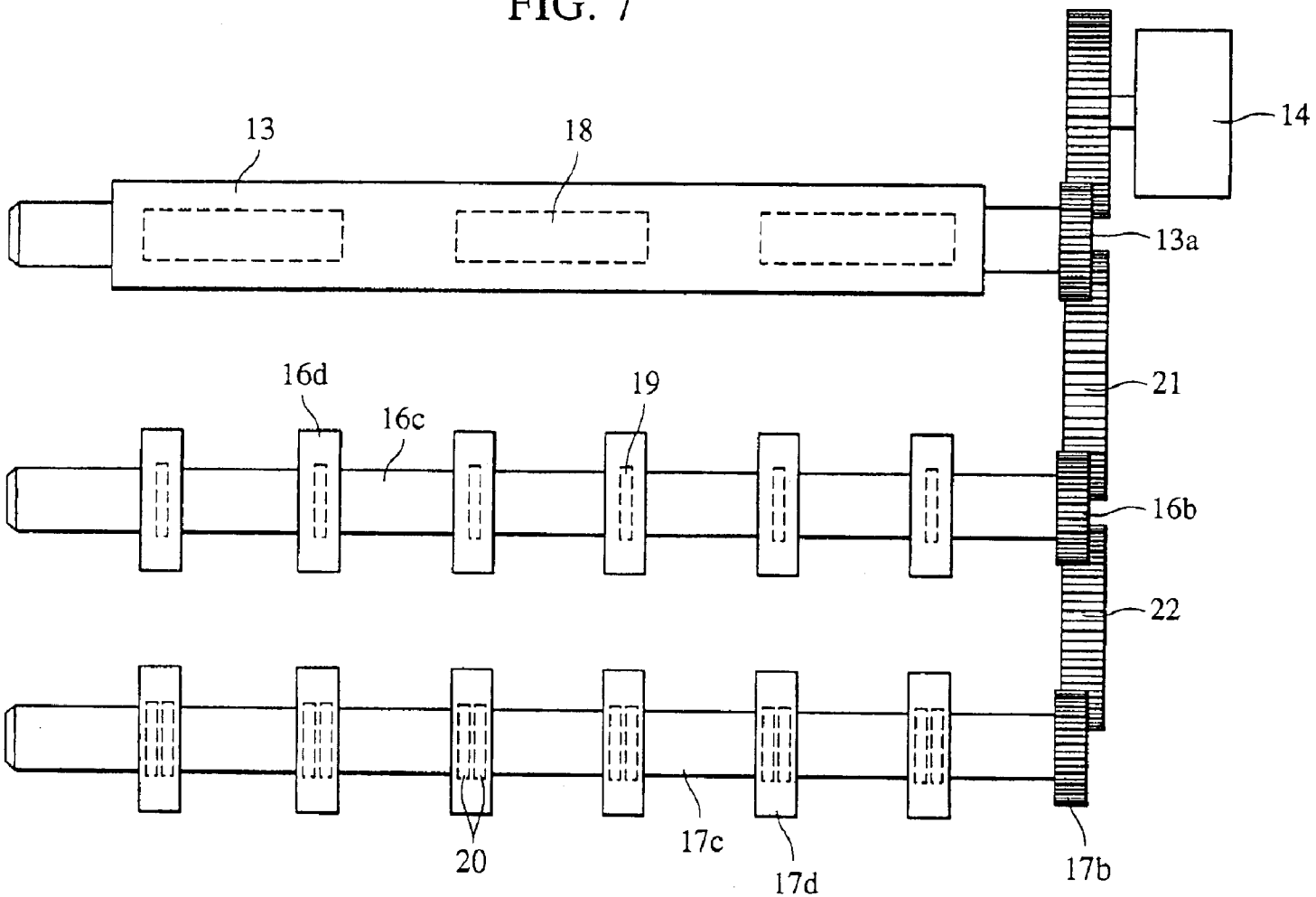
FIG. 7 is an upper view of a transporting unit and discharging unit according to a second embodiment.

At this time, preferably, two spurs 20 each are provided to each roller portion 17*d* of the second discharge roller 17, as shown in FIG. 7. In this way, using a configuration wherein a pair of spurs exert force of 20 [gf] (196 [mN]), the pressing force of the spurs 20 onto the roller portions 17*d* of the second discharging roller 17 is 20 [gf] (196 [mN]) which is twice that in the first embodiment, but the pressing force for each of the spurs 20 is still 10 [gf] (98 [mN]), and the pressing force on the sheet P is also still 10 [gf] (98 [mN]), so there is no excessive force placed on the recorded sheet P, thereby preventing damage to the surface of the sheet P, and obtaining good recording results.

As described above, according to the present embodiment, making the pressing force of the second spurs 20 as to the roller portions 17*d* of the second discharging roller 17 which is farthest downstream to be greater than the pressing force of the first spurs 19 as to the roller portions 16*d* of the first discharging roller 16 situated upstream allows the transporting precision to be further improved with only the discharge rollers, and good recorded images can be provided at the trailing end of the sheet.

Note that the values, material, etc., listed in the present embodiment are only examples, and the present invention need not be restricted to these values, material, etc.

Third Embodiment

Figure 8:
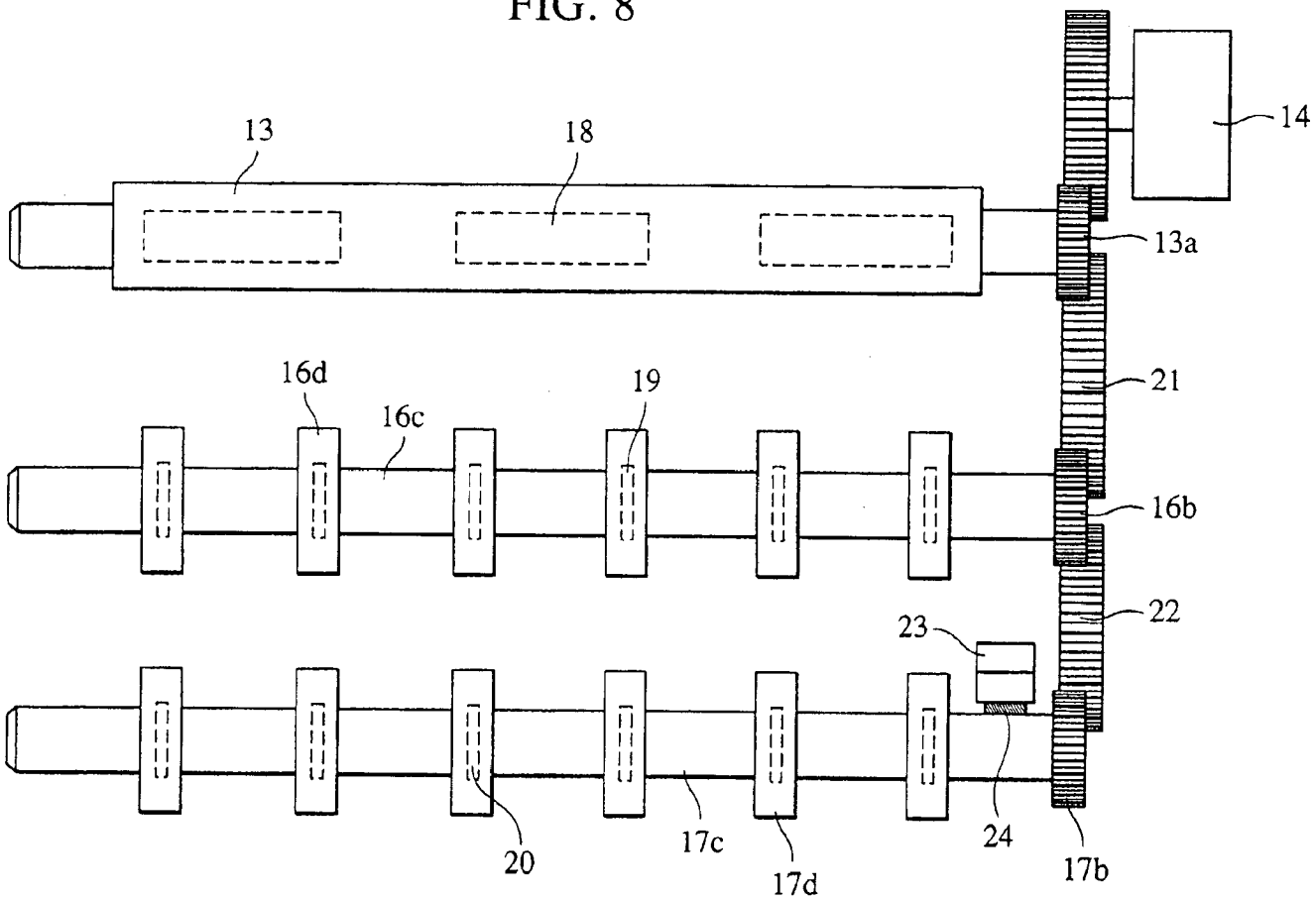
FIG. 8 is an upper view of a transporting unit and discharging unit according to a third embodiment.

A third embodiment will be described with reference to FIGS. 8 and 9. With the third embodiment, the configuration is such that load torque is applied to the second discharging roller. FIG. 8 is an upper view of a transporting unit and discharging unit according to the third embodiment, and FIG. 9 is a cross-sectional view of the second discharging roller.

Figure 9:
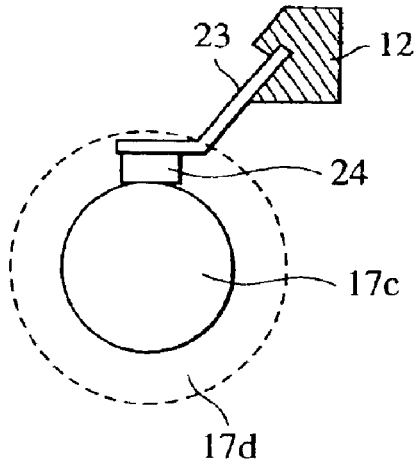
FIG. 9 is a cross-sectional view of a second discharging roller according to the third embodiment.

In FIG. 9, the configuration involves a friction pad 24 being pressed against the shaft portion 17*c* of the second discharging roller 17 by a leaf spring 23. With the present embodiment, synthetic leather is used for the friction pad 24, and a 0.3 mm plate of SUS304 is used for the leaf spring 23. The load torque applied to the shaft 17*c* is within the range of 0.294 N·cm to 1.47 N·cm (30 gf·cm to 150 gf·cm). Providing load torque to the shaft 17*c* as described above removes backlash from the roller gear 17*b*. Accordingly, the roller gear 17*b* is prevented from rotating forwards by an amount equivalent to the amount of backlash, gear driving is performed with high precision, and the transporting precision of the sheet P is further improved.

Fourth Embodiment

Figure 10:
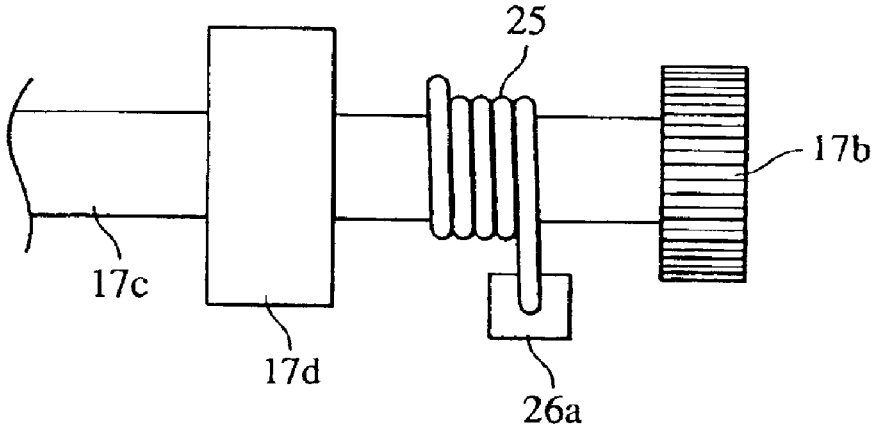
FIG. 10 is an upper view of the second discharging roller according to a fourth embodiment.

A fourth embodiment will be described with reference to FIGS. 10 and 11. With the fourth embodiment, the configuration is such that load torque is applied to the second discharging roller by a clutch spring. FIG. 10 is an upper view of a transporting unit and second discharging roller according to the fourth embodiment, and FIG. 11 is a cross-sectional view of the second discharging roller.

Figure 11:
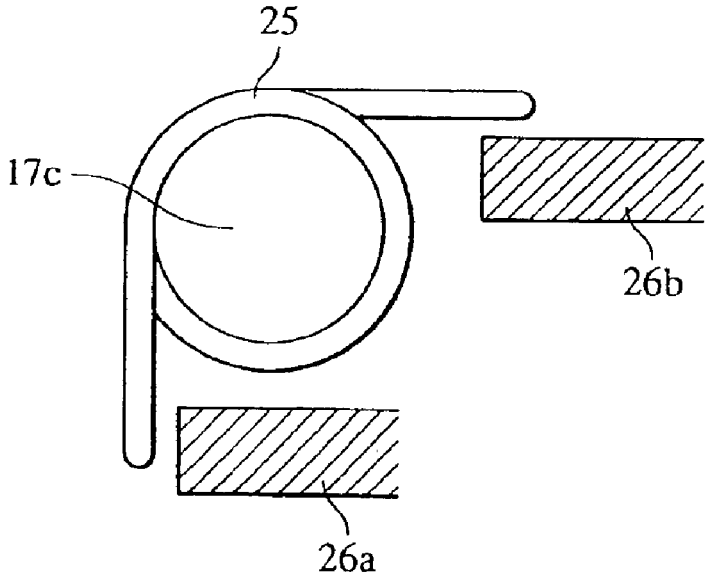
FIG. 11 is a cross-sectional view of the second discharging roller according to the fourth embodiment.

In FIG. 11, ribs 26*a* and 26*b* are provided near both edges of a clutch spring 25. Accordingly, in the event that the shaft 17*c* rotates in either the forward or reverse direction, force acts in the direction whereby the clutch spring 25 loosens, and so loosening torque of the clutch spring 25 is applied to the shaft 17*c*. With the present embodiment, SUS303 having a wire diameter of 0.45 mm is used for the clutch spring 25. The load torque applied to the shaft 17*c* is of a value approximately the same as that in the third embodiment.

Fifth Embodiment

Figure 12:
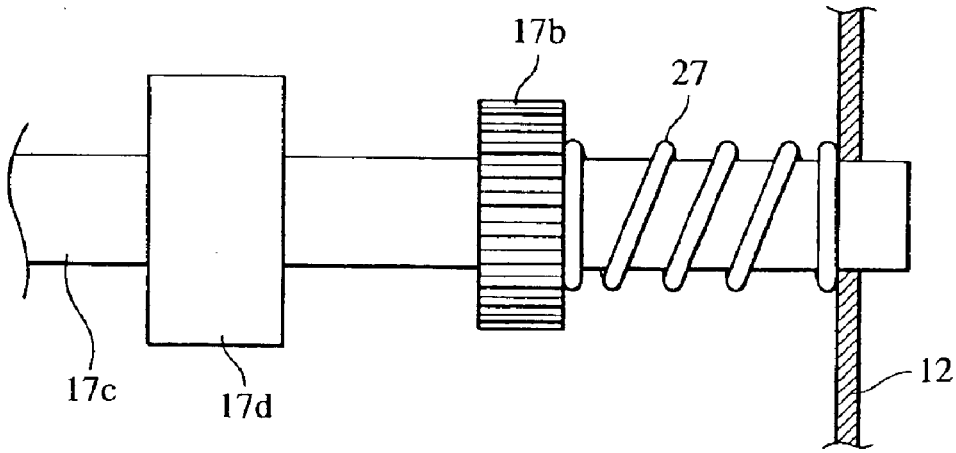
FIG. 12 is an upper view of the second discharging roller according to a fifth embodiment.
Figure 13:
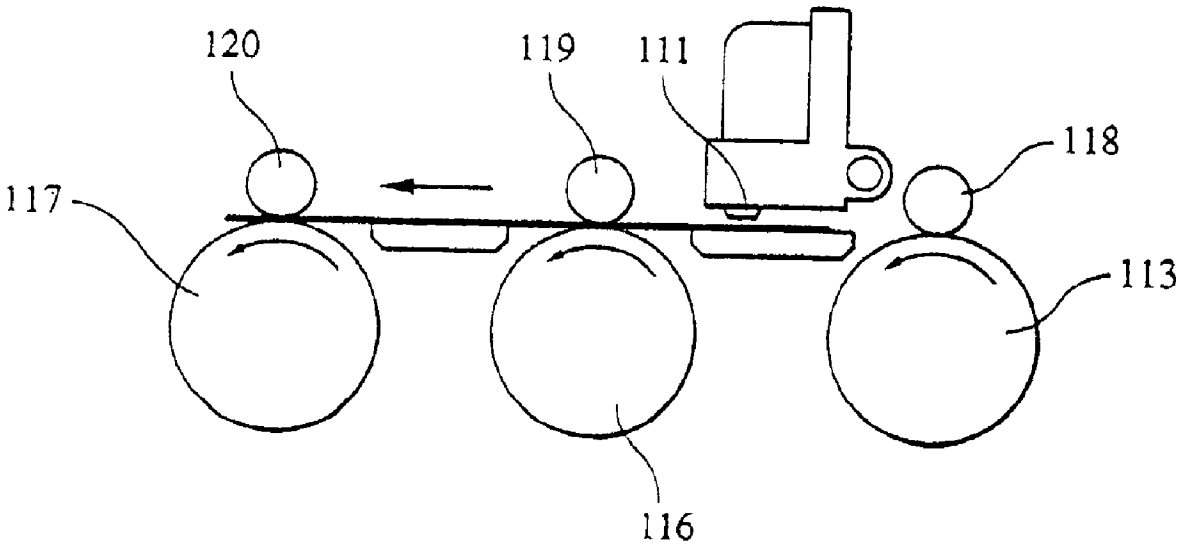
FIG. 13 PRIOR ART
FIG. 13 is a cross-sectional view of a conventional transporting unit and discharging unit.

A fifth embodiment will be described with reference to FIG. 12. With the fifth embodiment, the configuration is such that load torque is applied to the second discharging roller by a compression coil spring 27. FIG. 12 is an upper view of the second discharging roller according to the fifth embodiment.

In FIG. 12, a compression coil spring 27 is inserted between the platen 12 which supports the shaft 17*c* and the roller gear 17*b*, thereby applying friction load to the roller gear 17*b* and generating load torque. With the present embodiment, SUS303 having a wire diameter of 0.7 mm is used for the compression coil spring 27. The load torque applied to the shaft 17*c* is of a value approximately the same as that in the third embodiment.

Sixth Embodiment

With the above-described embodiments, a thermoplastic elastomer with a hardness of 70° (by the measuring method for hardness set forth in JIS (Japan Industrial Standard) A) and EPDM rubber material were used for the roller portions 16*d* and 17*d* of the first discharging roller 16 and the second discharging roller 17, but with the present embodiment, further improvement in transporting precision can be achieved by setting the friction coefficient $\mu$ of the roller portions 17*d* of the second discharging roller 17 situated farthest downstream in the sheet transporting direction as to the sheet P so as to be greater than the friction coefficient $\mu$ of the roller portions 16*d* of the first discharging roller 16 situated further upstream in the sheet transporting direction as to the sheet P.

With the present embodiment, EPDM with a hardness of 50° was used for the roller portions 17*d* of the second discharging roller 17, and an elastomer with a hardness of 90° was used for the roller portions 16*d* of the first discharging roller 16. The friction coefficient $\mu$ of the two as to the sheet P was 1.2 for the former and 0.8 for the latter, and in the event that the same pressing force is applied, the article with a hardness of 50° is capable of applying a greater transporting force to the sheet P. Accordingly, the degree of bearing on the precision of transporting sheets P with the second discharging roller 17 having higher roller precision becomes even higher, further improving transporting precision.

As described above, according to the present embodiment, the friction coefficient of the second discharging roller 17 situated farthest downstream in the sheet transporting direction as to the sheet P is greater than the friction coefficient of the first discharging roller 16 situated upstream in the sheet transporting direction as to the sheet P, allowing the transporting precision to be further improved with only the discharge rollers, and good recorded images can be provided at the trailing end of the sheet.

Note that the values, material, etc., listed in the present embodiment are only examples, and the present invention need not be restricted to these values, material, etc.

Seventh Embodiment

With the above-described embodiments, the type and number of recording heads have not been specifically described, but the present invention can be applied regardless of the type and number of recording heads, such as with ink-jet recording apparatuses which use one recording head, color recording ink-jet recording apparatuses which use multiple recording heads for recording with inks of different colors, gradient recording ink-jet recording apparatuses which use multiple recording heads for recording with inks of the same color in different concentrations, and so forth, and the above-described advantages can be obtained regardless to which of these the present invention is applied.

Further, as for the recording means (recording head), the present invention can be applied in the same manner and obtain the same advantages regardless of the configuration of the recording means and the ink tank, such as cartridge-type arrangements wherein the recording head and ink tank are formed integrally, arrangements wherein the recording head and ink tank are formed separately and connected by ink supplying tubes, and so forth.

In the event of applying the present invention to an ink-jet recording apparatus, recording means using electro-mechanical converters or the like such as piezo-electric devices or the like, for example, can be applied for the recording means, but the present invention exhibits the advantages thereof most markedly with ink-jet recording apparatuses using recording means wherein thermal energy is used to discharge ink, since this method achieves high density and fine recording.

Further, the present invention can be effectively applied to full-line recording heads having a length corresponding to the maximum breadth of the recording medium recordable by the recording apparatus. Such recording heads may be of a configuration wherein multiple recording heads are combined to satisfy the length thereof, or a configuration wherein a single recording head is formed integrally. Additionally, the present invention is effective using the above-described serial type recording heads, recording heads fixed to the apparatus proper, exchangeable chip-type recording heads which are capable of receiving supply of electrical connection from the apparatus main unit and supply of ink from the apparatus main unit by being mounted thereto, or cartridge type recording heads to which ink tanks have been integrally formed.

Also, the form of the above ink-jet recording apparatus may be one used as an image output terminal apparatus for information processing equipment such as computers or the like, an ink-jet input/output apparatus wherein a scanner or the like can be mounted to the carriage besides a recording head, a photocopier apparatus combined with a reader or the like, a facsimile apparatus further having transmitting/receiving functions, and so forth.

Also, although the above embodiments have been described with reference to the ink-jet recording method as the recording method, the present invention is by no means restricted to this; rather, the present invention is also applicable to other recording methods such as thermal transfer recording methods, thermal-sensitive recording methods, impact recording methods such as wire-dot recording, or other electro-photography recording methods, etc.

As described above, according to the present embodiments, with an apparatus having a plurality of discharging rollers for transporting sheets downstream of the recording means in the transporting direction, the discharging roller of the multiple discharging rollers disposed farthest downstream in the sheet transporting direction is formed with precision higher than discharging rollers disposed further upstream, and accordingly the transporting precision can be improved with only the multiple discharging rollers, thereby providing good recorded images at the trailing end of the sheets. At this time, inexpensive materials and manufacturing methods can be used for the upstream discharging rollers of the plurality of discharging rollers, so the above-described advantages can be obtained without great increases in costs.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An inkjet recording apparatus for discharging ink from a recording head to perform recording on a recording sheet, said recording apparatus comprising:

a platen for guiding the recording sheet, said platen being positioned opposite to the recording head;

a transporting roller for transporting the recording sheet, said transporting roller being positioned upstream of the recording head relative to the transporting direction;

a proximal discharging roller attached to said platen for transporting the recording sheet, said proximal discharging roller being positioned downstream of the recording head relative to the transporting direction, said proximal discharging roller having a shaft serving as a center of rotation formed of resin and a rubber roller portion for integrally rotating with said resin shaft to transport the recording sheet; and a distal discharging roller attached to said platen for transporting the recording sheet, said distal discharging roller being positioned downstream of said proximal discharging roller relative to the transporting direction, said distal discharging roller having a shaft serving as a center of rotation formed of metal and a rubber roller portion for integrally rotating with said metal shaft to transport the recording sheet.

2. An inkjet recording apparatus according to claim 1, wherein said proximal discharging roller has deviations from a nominal circumference within a first range, and said distal discharging roller has deviations from a nominal circumference within a second range and is of higher precision than said proximal discharging roller in that the second range is less than the first range.

* * * * *